United States Patent [19]

Kawahara

[11] 4,054,971

[45] Oct. 25, 1977

[54] CLASPING DEVICE

[75] Inventor: Akira Kawahara, Kagawa, Japan

[73] Assignee: Ryusyo Industrial Co., Ltd., Osaka, Japan

[21] Appl. No.: 695,963

[22] Filed: June 14, 1976

[30] Foreign Application Priority Data

July 26, 1975 Japan ..... 50-103613[U]

[51] Int. Cl.[2] ..... B66F 3/00

[52] U.S. Cl. ..... 24/68 CD

[58] Field of Search ..... 254/51, 77, 78, 79, 254/161, 164; 24/68 CD, 68 D, 68 T, 68 SK

[56] References Cited

U.S. PATENT DOCUMENTS

| | | | |
|---|---|---|---|
| 2,555,660 | 6/1951 | Russell | 254/78 |
| 2,679,670 | 6/1954 | Griswold | 24/68 CD |
| 3,099,055 | 7/1963 | Huber | 24/68 CD |

*Primary Examiner*—Robert C. Watson

*Attorney, Agent, or Firm*—Wenderoth, Lind & Ponack

[57] ABSTRACT

A clasping device for fastening an object relative to a foundation or for fastening objects together which comprises a manipulatable lever means pivotable between locked and unlocked positions, a holder means pivotally connected to one end of the manipulatable lever means, and a substantially U-shaped body having one end pivotally connected to the manipulatable lever means. A length of flexible strap extends first through the substantially U-shaped body in one direction and again through the body in the opposite direction after having been turned around a stanchion carried by the manipulatable lever means. As the manipulatable lever means is pivoted from the unlocked position towards the locked position, the stanchion around which the strap is turned angularly moved about the pivotal connection between the manipulatable lever means and the body, thereby drawing the holder in relation to and towards the body.

13 Claims, 8 Drawing Figures

CLASPING DEVICE

The present invention relates to a releaseable clasping device for clasping or fastening a flexible strap to hold on object firmly in position.

According to the Japanese Utility Model Publication (Unexamined) No. 44690/1974 which was laid open to public inspection in 1974, there is disclosed a releaseable clasping device for fastening a flexible strap, encircled around packages to hold them together. This known clasping device is illustrated in FIG. 8 of the accompanying drawings and will now be described with reference thereto.

FIG. 8 illustrates a side sectional view of the known clasping device disclosed in the Japanese Utility Model Publication referred to above. The known clasping device comprises a length of flexible strap 1 having one end secured to a holder 2 pivotally connected to an elongated body of substantially U-shaped cross section. The elongated body includes a pair of spaced parallel plates 3 of substantially scalene triangular shape and has a pair of spaced stanchions 4 and 5 integral with and bridging between these parallel plates 3. While a substantially intermediate portion of the strap 1 is encircled around packages (not shown, but a surface of one of which packages is shown by the chail and indicated by P), the other end of the flexible strap 1 substantially extends through a space between the parallel plates 3, after having first been turned around and externally of the stanchion 4, then around the stanchion 5 and finally around and internally of the stanchion 4.

When the packages are to be fastened together, a first necessary procedure is to pull the free end of the flexible strap 1 in a direction as indicated by F and in a direction opposed to the holder 2 being then pulled in the direction counter to the direction in which the free end of the flexible strap 1 is pulled. At this time or when the free end of the flexible strap 1 is so pulled in the direction F, the front edges, as at 3*a*, of the parallel plates 3 are held flatly against the package surface P.

Thereafter, a manipulatable lever portion 6 of the elongated body is, while the free end of the flexible strap 1 is still pulled in the direction F, depressed by the application of an external pushing force thereto, thereby establishing the condition substantially as shown in FIG. 8. As best shown in FIG. 8, depression of the manipulatable lever portion 6 so effected in a direction towards the package surface P causes the elongated body to pivot clockwise about the obtuse angled edges, as at 3*b*, of the parallel plates 3, which obtuse angled edges 3*b* turn in frictional contact with the package surface P.

At the time the clasping device is locked by further depressing the manipulatable lever portion 6, the side edges, as at 3*c*, of the parallel plates 3 are held flat against the package surface P on one hand, and on the other hand, the longitudinal axis of the stanchion 5 is moved in a direction towards the package surface P and assumes a position between the package surface P and the imaginary plane passing through the longitudinal axis of the stanchion 4 in parallel relation to the package surface P, thereby substantially avoiding any accidental counterclockwise turn of the manipulatable lever portion 6. Any accidental unlocking of the clasping device, which may otherwise result in slackening of the flexible strap 1 is thereby prevented.

The known clasping device of the above described construction has been found to be an instrument convenient to temporarily hold the packages together and to readily release them from each other. However, it has been found that the known clasping device has some disadvantages. By way of example, after the manipulatable lever portion 6 has been pivoted about the point of contact of the obtuse angled edges 3*b* of the parallel plates 3 with the package surface P to a substantially intermediate position between unlocked and locked positions by the application of the external pushing force thereto during a fastening operation, the external pulling force applied to the free end of the flexible strap 1 in the direction F no longer acts on a major portion of the flexible strap 1 encircling the packages. This is because a portion of the strap 1 which is turned around the stanchion 4 tightly presses another portion of the same strap 1 which is turned around the stanchion 4, but is passed through between the stanchion 4 and that portion of the strap 1 around said stanchion 4 with the intervention of said another portion of said strap 1. Therefore, the extent to which the packages are fastened together by the strap 1 at the time the clasping device has been locked depends upon how far the strap 1 has been pulled by the application of the external pulling force to the free end thereof.

In other words, the extent to which the packages are fastened together is determined by how far one operating the clasping device can pull the free end of the strap 1 away from the clasping device and then lock it.

In addition, where the known clasping device is employed to connect an object to be fixed to a fixed portion, such as in the case where an automobile to be transported by a ferry or freighter is to be fixed relative to a deck within a hold of the ferry or freighter, with the clasping device supported in the air between two lengths of strap which respectively extends from the automobile and the hold deck, the clasping device can hardly be locked. More specifically, in such case, since there is no surface to which the front edges 3*a* of the parallel plates 3 are engaged and the unlocked position of the manipulatable lever portion 6 becomes far spaced from the locked position thereof as the free end of the strap is pulled in the direction F, a relatively great amount of combined pulling and pushing force is necessary to turn the manipulatable lever portion from the unlocked position towards the locked position once the two lengths of straps have been held under tension.

These disadvantages inherent in the known clasping device can substantially be overcome according to the present invention. In particular, a clasping device constructed in accordance with the teachings of the present invention comprises a manipulatable lever means pivotable between locked and unlocked positions, a holder means pivotally connected to one end of the manipulatable lever means, and a substantially U-shaped body having one end pivotally connected to the manipulatable lever means. In this construction, a length of flexible strap, preferably made of a belt of woven cloth, such as canvas, or leather, extends first through the substantially U-shaped body in one direction and again through the substantially U-shaped body in the opposite direction after having been turned around a stanchion carried by the manipulatable lever means. Therefore, as the manipulatable lever means is pivoted from the unlocked position towards the locked position, the stanchion, around which the strap is turned, angularly moves about the pivotal connection between the manipulatable lever means and the substantially U-shaped body, thereby drawing the holder in relation to and towards the U-shaped body.

In view of the structural feature of the clasping device according to the present invention, the extent to which the packages are fastened together by the strap at the time the clasping device has been locked is ultimately determined by the relative movement between the manipulatable lever means and the U-shaped body and, therefore, one who handles the clasping device of the present invention may not pull the free end of the flexible strap to such an extent that the major portion of the strap, encircled around the packages to be fastened together, become held under tension sufficient to hold them tightly together at the time the clasping device is to be locked. In other words, with the clasping device of the present invention, it may not always be required to pull the strap to hold the packages tightly together at the time the clasping device is to be locked. A slight slackening may be present in the strap, in which case such slackening of the strap can advantageously be compensated for by the relative movement of the manipulatable lever means with respect to the substantially U-shaped body.

Although the clasping device according to the present invention has a wide range of application, not only in fastening packages together, but also in fixing one or more objects to a foundation, it is suited for use in fastening an automobile to a deck within a hold of a ferry or freighter during transportation of such automobile by such ferry or freighter at sea.

In any event, these and other objects and features of the present invention will become apparent from the following description taken in conjunction with preferred embodiments thereof with reference to the accompanying drawings, in which.

Figure 1:
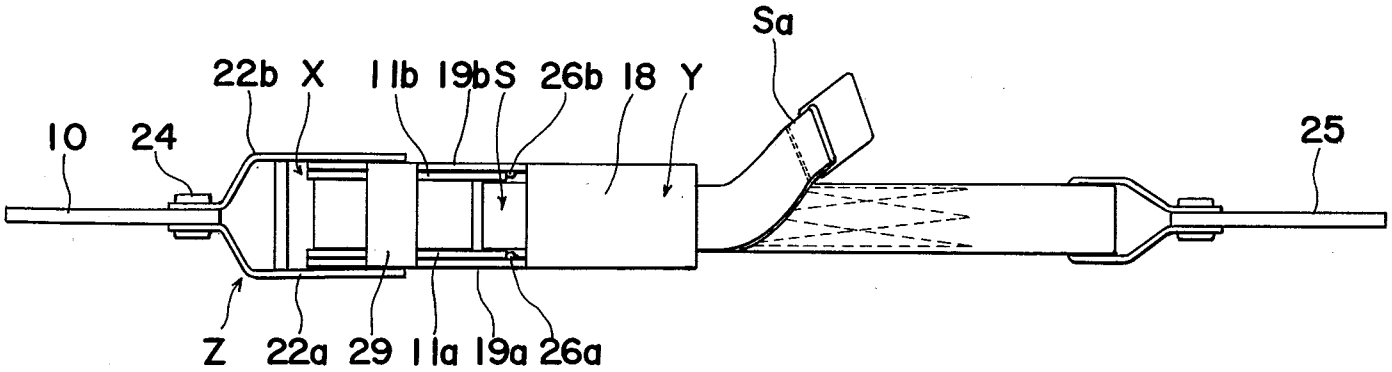
FIG. 1 is a top plan view of a clasping device according to one preferred embodiment of the present invention.
Figure 2:
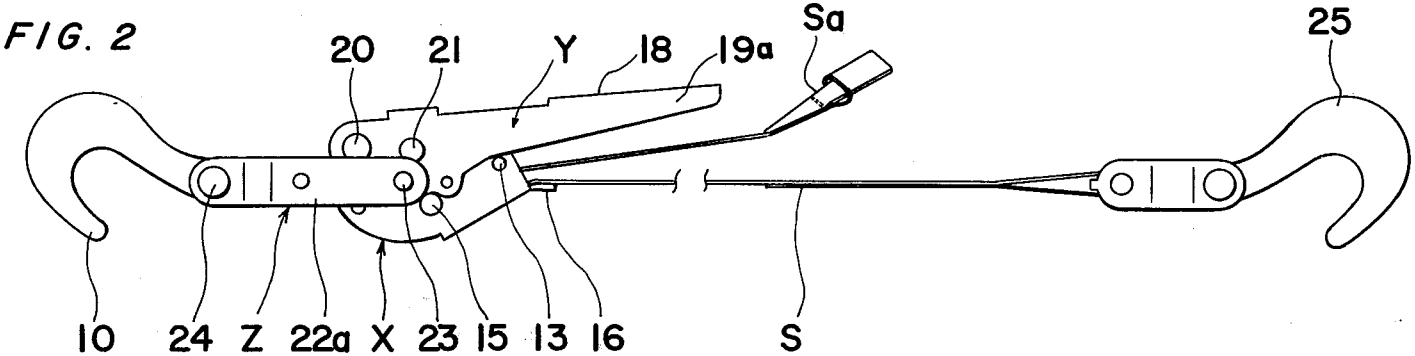
FIG. 2 is a side elevational view of the clasping device shown in FIG. 1.
Figure 3:
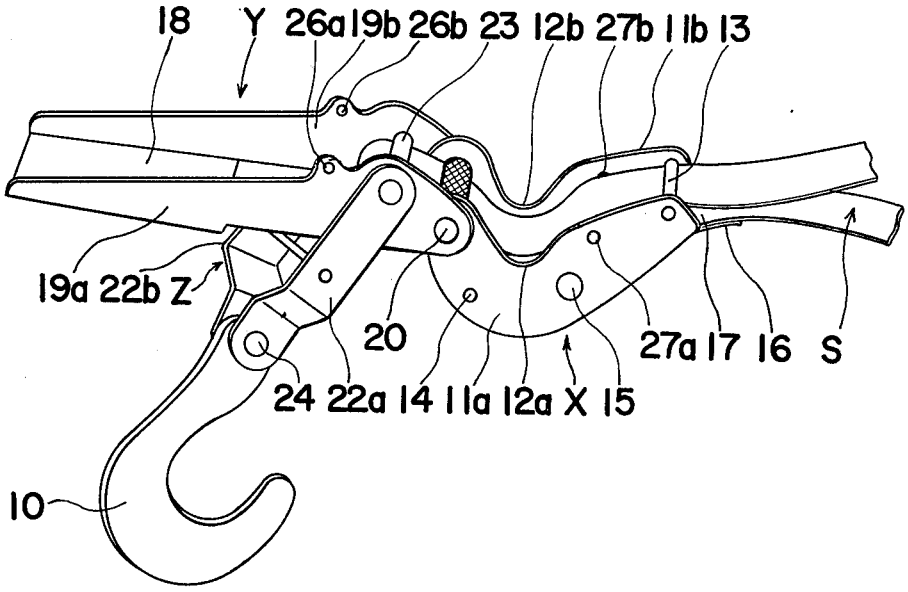
FIG. 3 is a perspective view, on an enlarged scale, of the clasping device shown in FIG. 1.

Before the description of the present invention proceeds, it is to be noted that like reference numerals are employed to designate like parts throughout the accompanying drawings. It is also to be noted that, for the sake of brevity, the clasping device according to the present invention will be described as used in fastening an automobile to be transported by a ferry to a hold deck in the ferry, it being understood that the present invention is not limited thereto.

With reference to FIGS. 1 to 5, a clasping device constructed in accordance with the teachings of the present invention basically comprises a substantially U-shaped body X, a manipulatable lever means Y having one end pivotally connected to said body X and a holder Z having one end pivotally connected to the manipulatable lever means Y and the other end having a hook member 10 pivotally connected thereto.

The U-shaped body X is constituted by a pair of substantially U-shaped plate members 11*a* and 11*b* connected to and in spaced relation to each other by means of a plurality of spacer pins 13, 14 and 15. Each of the plate members 11*a* and 11*b* has one side edge convexed and the opposed side edge concaved to provide a recess 12*a* or 12*b* and is, therefore, rendered to represent a substantial shape of a figure "U". Adjacent the spacer pin 13, a guide tongue 16 is provided with respective side edges thereof connected to, or otherwise integrally formed with, portions of the convexed side edges of the plate members 11*a* and 11*b.* This guide tongue 16 defines in cooperation with said spacer pin 13 a clearance 17 through which a length of strap S loosely extends in a manner as will be described in more detail.

Figure 4:
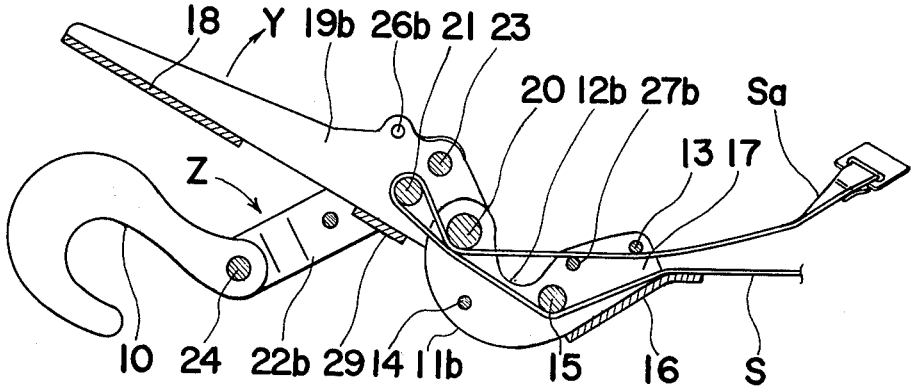
FIG. 4 is a side sectional view of the clasping device shown in FIG. 3, which is illustrated in one operative position.
Figure 5:
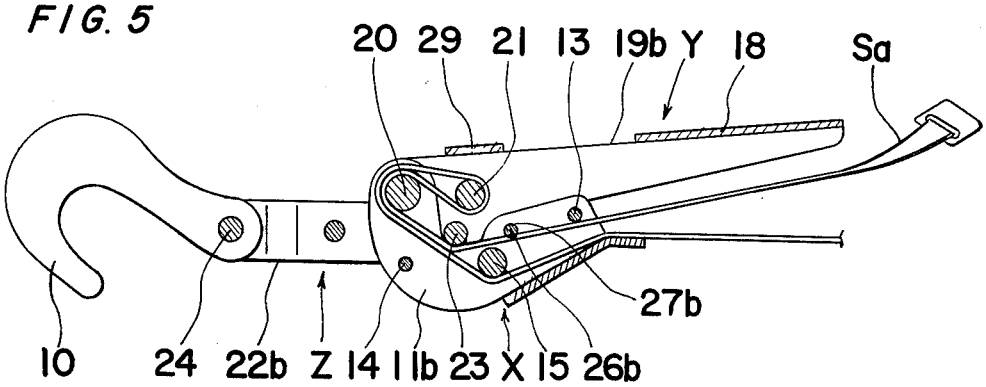
FIG. 5 is a view similar to FIG. 4, the clasping device being shown in another operative position.

The manipulatable lever means Y is constituted by an elongated plate 18 which has the opposed side edges integrally connected with respective levers 19*a* and 19*b* of the same shape, each of the levers 19*a* and 19*b* lying at right angles to the plane of the elongated plate 18. This manipulatable lever means Y has one end pivotally connected to one end of the body X, which is remote from the clearance 17, by means of a pin member 20 which extends from one end of one lever 19*a* to one end of the other lever 19*b* after having passed through the plate member 11*a* and the plate member 11*b.* The manipulatable lever means Y of the above construction is manually pivotable about the longitudinal axis of the pin member 20 between the unlocked position, as shown in FIG. 4, and the locked position, as shown in FIG. 5. The manipulatable lever means Y has a stanchion 21 extending between the levers 19*a* and 19*b.*

The holder Z is constituted by a pair of arm members 22*a* and 22*b* and has one end pivotally connected to the manipulatable lever means Y by means of a connecting pin member 23 which extends from one end of one arm member 22*a* to one end of the other arm member 22*b* after having passed through the lever 19*a* and the lever 19*b.* At the opposite end of the holder Z, a hook 10 is pivotally connected with thereto by means of a connecting member 24 extending from the arm member 22*a* to the arm member 22*b* with one end of the hook 10 sandwiched therebetween.

While the clasping device according to the present invention is constructed as hereinbefore described, a length of the strap S extends from its free end S*a* towards another hook 25, after first passing through the clearance 17, then turns around the stanchion 21 after having been deflected by the pin member 20 and, after having again been deflected by the spacer pin 15, finally emerges through the clearance 17.

The operation of the clasping device of the present invention will now be described with particular reference to FIGS. 4 and 5.

Assuming that the manipulatable lever means Y is held in the unlocked position as shown in FIG. 4 and that the hook 10 is engaged to an eyelet (not shown) secured to the hold deck in the ferry while the hook 25 is engaged to a corresponding hook member (not shown) secured to the automobile, the first procedure is to pull the free end S*a* of the strap S in a direction opposed to the hook 10. When the portion of the strap S, which extends between the stanchion 21 and the hook 25 is held under tension with the hooks 10 and 25 pulled in the opposite directions away from each other, the clasping device is then fastened. This can readily be achieved merely by turning the manipulatable lever means Y about the pin member 20 from the unlocked position towards the locked position substantially as shown in FIG. 5. As the manipulatable lever means Y is so pivoted, the hook 10 is drawn close to to the body X while said hook 10 pivots about the connecting pin member 23 and the connecting member 24. The longitudinal axis of the connecting member 24 tends to align with the direction in which a straightened portion of the strap S between the body X and the hook 25 is pulled under tension.

When the manipulatable lever means Y has been positioned at the locked position as shown in FIG. 5, the straightened portion of the strap S between the body X and the hook 25 are brought into line with the longitudinal axis of the connecting member 24 and, more particularly, the holder Z, as shown. At the same time, a portion of the connecting pin member 23 between the levers 19*a* and 19*b* is accommodated within a space defined by the recesses 12*a* and 12*b* in the plate members 11*a* and 11*b.* On the other hand, a portion of the strap S, which has been described as deflected in contact with the connecting pin member 20 is turned around said pin member 20 while being tightly pressed thereagainst by a portion of the strap S extending between the stanchion 21 and the spacer pin 15. This portion of the strap S between the stanchion 21 and the spacer pin 15 is also turned around the connecting pin member 20 externally of and in overlapping relation to that portion of the strap S turned in contact with the connecting pin member 20. It is to be noted that, as the manipulatable lever means Y is moved towards the locked position, the area of contact of that portion of the strap S, which is adjacent the free end S*a* of the strap S and is deflected in contact with said pin member 20, will the connecting pin member 20 gradually increases accompanying a corresponding increase of the area of contact of that portion of the strap S between the stanchion 21 and the spacer pin 15 to that portion of the strap S externally of and in overlapping relation will said portion of the strap S between said stanchion 21 and the spacer pin 15.

Therefore, it is clear that there is no possibility that, even though the external pulling force necessary to bring that portion of the strap S between the body X and the hook 25 under substantial tension is no longer applied to the free end S*a* of the strap S shortly before the manipulatable lever means Y is moved to the locked position, a portion of the strap S between the body X and the free end S*a* thereof will be drawn into the clearance 17 thereby slackening the once-tensioned portion of the strap S between the body X and the hook 25.

If the manipulatable lever means Y in the locked position is moved back towards the unlocked position about the connecting pin member 20 by the application of an external pulling force, Y the clasping device of the present invention can readily be unlocked, thereby loosening that portion of the strap S between the body X and the hook 25.

Preferably, the connecting pin member 20 has a peripheral surface roughened or rouletted or otherwise formed with a pattern of indentations, thereby avoiding any possible frictional slip between the connecting pin member 20 and that portion of the straps S deflected in contact with said pin member 20 after the manipulatable lever means Y has been pivoted to the locked position.

It is to be noted that either the spacer pin 15 or the connecting pin member 20 should be positioned relative to the plate members 11*a* and 11*b* such that the portion of the strap S between the connecting pin member 20 and the spacer pin 15 extends clear of the space defined by the recesses 12*a* and 12*b* in the respective plate members 11*a* and 11*b.*

In order to avoid any possible accidental release of the manipulatable lever means Y from the locked position, the clasping device of the present invention may have means for holding the manipulatable lever means Y in the locked position. In the embodiment illustrated in FIGS. 1 to 5, the means for holding the manipulatable lever means Y is shown to comprise a pair of opposed projections, formed at 26*a* and 26*b* on the respective levers 19*a* and 19*b* and protruding therefrom in the opposite directions away from each other at right angles to the associated levers 19*a* and 19*b.* Detent holes cooperative with said projections 26*a* and 26*b* and are defined at 27*a* and 27*b* in the respective plate members 11*a* and 11*b.* It will readily be seen that, when the manipulatable lever means Y is pivoted to the locked position, the projections 26*a* and 27*b* respectively click into the corresponding detent holes 27*a* and 27*b,* thereby holding the manipulatable lever means Y firmly in the locked position. Release of the manipulatable lever means Y so firmly held in the locked position can be achieved in a similar manner as hereinbefore described, but requires a greater external pulling force than that applied in the case where no means for holding the manipulatable lever means Y in the locked position is employed.

Figure 6:
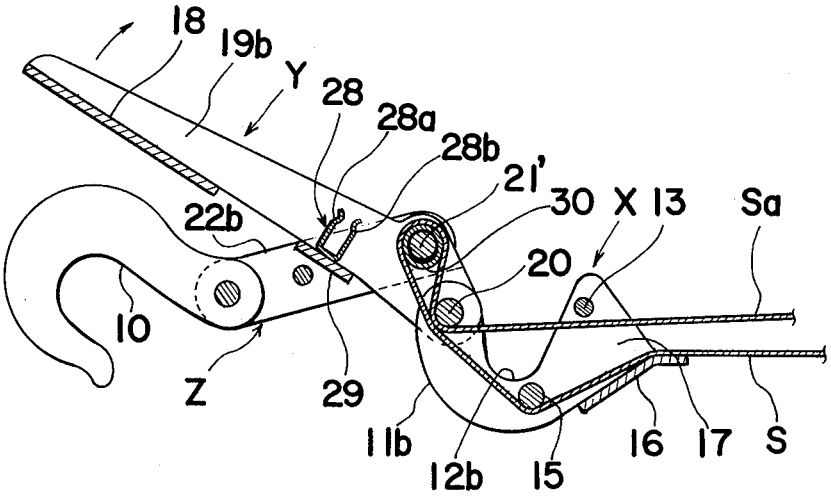
FIGS. 6 and 7 are views similar to FIGS. 4 and 5, respectively, showing the clasping device according to another preferred embodiment of the present invention.
Figure 7:
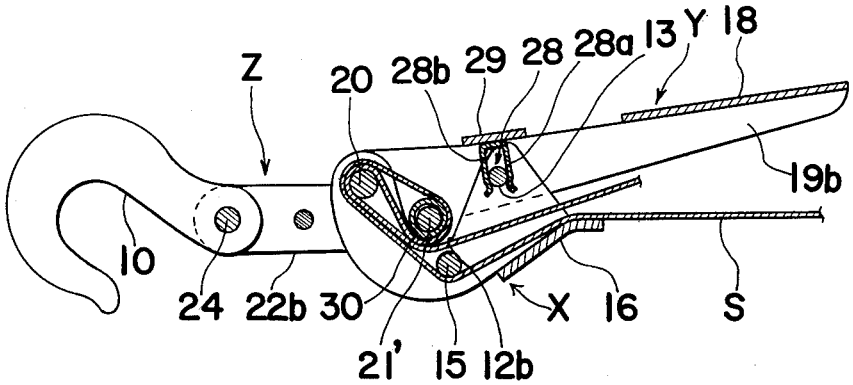
Figure 8:
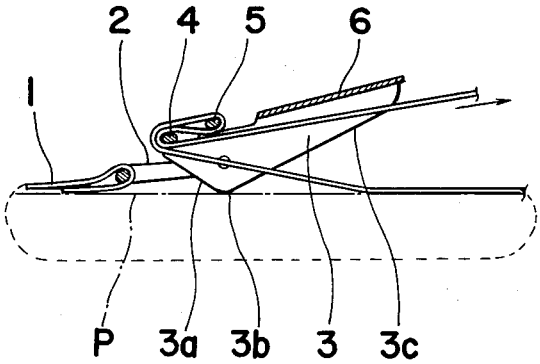
FIG. 8 is a side sectional view of the prior art clasping device to which reference has already been made.

Alternatively, the means for holding the manipulatable lever means Y such as shown in FIGS. 6 and 7 may be employed. This alternative means comprises a clip 28 secured to a bridge member 29 straddling the levers 19*a* and 19*b* in a similar fashion to the elongated plate 18 and having a pair of spaced legs 28*a* and 28*b.* Cooperative with this clip 28 is the spacer pin 13. When the manipulatable lever means Y is pivoted towards the locked position, the legs 28*a* and 28*b* of the clip 28 allow the spacer pin 13 to enter a space therebetween and finally bite said spacer pin 13 and firmly hold the manipulatable lever means Y in the locked position.

In the embodiment shown in FIGS. 1 to 5, it has been described that a portion of the strap S is turned around the stanchion 21 in contact with said stanchion 21. The area of contact of that portion of the straps S to said stanchion 21 is substantially constant and relatively great irrespective of the position of the manipulatable lever means Y and, therefore, a frictional resistance tends to be exerted between the stanchion 21 and that portion of the strap S during movement of the strap S in either direction and/or during angular movement of the stanchion 21 incident to the movement of the manipulatable lever means Y between the unlocked and locked positions. Where this frictional resistance is undesirable, one method of minimizing or substantially eliminate eliminating this resistance would be to make the stanchion 21 rotatable about its own longitudinal axis and another method would be to use a sleeve mounted on said stanchion 21, around which sleeve that portion of the strap S is turned.

The employment of such a sleeve is shown by 30 in FIGS. 6 and 7. However, it is to be noted that the stanchion 21' shown in FIGS. 6 and 7 corresponds in function to the combination of the stanchion 21 and connecting pin member 23 of FIGS. 1 to 5. In other words, the stanchion 21' serves not only as an element around which that portion of the strap S is turned through the sleeve 30 rotatably mounted thereon, but also as an element by which the holder Z is pivotally connected to the manipulatable lever means Y.

Although the present invention has fully been described in conjunction with the preferred embodiments thereof with reference to the accompanying drawings, it is to be noted that various changes and modifications are apparent to those skilled in the art. By way of example, instead of the employing the hook 10 and the hook 25, the end of the strap S which has been described as connected to the hook 25 may be connected to the holder Z, or another length of strap similar to the strap S may be employed to connect the hook 10 to the holder Z depending upon the purpose for which the clasping device of the present invention is practically applied.

Therefore, such changes and modifications are, unless they depart from the true scope of the present invention, to be understood as included within the scope of the present invention.

I claim:

1. A clasping device comprising:

a body comprised of a pair of plate members connected to each other in a spaced relationship, said pair of plate members having a first end and a second end opposite said first end and said first end having a clearance therethrough;

manipulatable lever means pivotally mounted on said second end of said body for pivotal movement on said body toward and away from said first end of said body, said lever means comprised of a pair of lever members connected to each other in a spaced relationship;

first and second pin members in spaced relation to each other positioned between said spaced plate members, said first pin member positioned through and connecting said lever means to said body;

a third pin member positioned between said spaced lever members;

a flexible strap having first and second ends and extending from said first end through said clearance in said first end of said body, past and in contact with said first pin member, around said third pin member and back past and in contact with said second pin member and back out said clearance when said manipulatable lever means is pivoted away from said body, said strap between said second and third pin members being turned around said first pin member in contact with said strap portion contacting said first pin member when said lever means is pivoted toward said body; and pulling force receiving means pivotally coupled to said manipulatable lever means for receiving an external pulling force acting in a direction substantially counter to the direction of said second end of said strap.

2. A clasping device as claimed in claim 1, further comprising:

a fourth pin member positioned between said spaced lever members adjacent said third pin member, said fourth pin member contacting and depressing said strap at the portion between said first end of said first pin member when said lever means is pivoted toward said body, and said fourth member further connecting said pulling force receiving means to said lever member.

3. A clasping device as claimed in claim 1 further comprising locking means on said lever means for engaging said body when said lever means is pivoted toward said body and locking said lever means in contact with said body.

4. A clasping device as claimed in claim 3 wherein said pulling force receiving means is pivotally coupled to said lever means by said third pin member.

5. A clasping device as claimed in claim 3 wherein said first pin member has an outer peripheral surface formed with a pattern of indentations.

6. A clasping device as claimed in claim 5, further comprising:

a first hook member attached to said second end of said strap; and wherein said pulling force receiving means is comprised of a holder pivotally connected to the end of said holder opposite the end connected to said lever means.

7. A clasping device as claimed in claim 5 wherein said pulling force receiving means is pivotally coupled to said lever means by said third pin member.

8. A clasping device as claimed in claim 7 further comprising a first hook member attached to said second end of said strap; and wherein said pulling force receiving means is comprised of a holder pivotally connected to said lever means and a second hook member pivotally connected to the end of said holder opposite the end connected to said lever means.

9. A clasping device as claimed in claim 3, further comprising a first hook member attached to said second end of said strap; and wherein said pulling force receiving means is comprised of a holder pivotally connected to said lever means and a second hook member pivotally connected to the end of said holder opposite the end connected to said lever means.

10. A clasping device as claimed in claim 1 wherein said first pin member has an outer peripheral surface formed with a pattern of indentations.

11. A clasping device as claimed in claim 10 wherein said pulling force receiving means is pivotally coupled to said lever means by said third pin member.

12. A clasping device as claimed in claim 1 wherein said pulling force receiving means is pivotally coupled to said lever means by said third pin member.

13. A clasping device as claimed in claim 1 further comprising a first hook member attached to said second end of said strap; and wherein said pulling force receiving means is comprised of a holder pivotally connected to said lever means and a second hook member pivotally connected to the end of said holder opposite the end connected to said lever means.

* * * * *